US007810813B2

(12) United States Patent
Denoual

(10) Patent No.: US 7,810,813 B2
(45) Date of Patent: Oct. 12, 2010

(54) DICE POKER GAME

(76) Inventor: Thierry Denoual, 1000 Illinois St., San Francisco, CA (US) 94107

( * ) Notice: Subject to any disclaimer, the term of this patent is extended or adjusted under 35 U.S.C. 154(b) by 0 days.

(21) Appl. No.: 12/398,936

(22) Filed: Mar. 5, 2009

(65) Prior Publication Data

US 2010/0225058 A1 Sep. 9, 2010

(51) Int. Cl.
*A63F 9/04* (2006.01)

(52) U.S. Cl. ..... 273/146; 273/148 R; 273/309

(58) Field of Classification Search ..... 273/146, 273/274, 268, 309, 148 R; D21/392
See application file for complete search history.

(56) References Cited

U.S. PATENT DOCUMENTS 1,481,628 A * 1/1924 Souza ..... 273/146
1,578,554 A * 3/1926 Seligman ..... 273/153 R
2,572,333 A * 10/1951 Greitzer ..... 108/90
3,165,318 A * 1/1965 Lissandrello ..... 273/272
4,258,919 A 3/1981 Martelli
4,436,306 A 3/1984 Sanders
4,648,602 A * 3/1987 Maroney ..... 273/146
5,265,882 A * 11/1993 Malek ..... 273/292
5,405,145 A 4/1995 Jones et al.
6,511,070 B1 * 1/2003 Daines ..... 273/292
6,575,467 B1 * 6/2003 Kal ..... 273/292
6,598,880 B2 * 7/2003 Addabbo ..... 273/306
6,698,759 B2 * 3/2004 Webb et al. ..... 273/292
6,705,613 B1 * 3/2004 Wirth ..... 273/274
6,840,517 B2 * 1/2005 Snow et al. ..... 273/292
7,118,111 B1 * 10/2006 Altomare ..... 273/292

* cited by examiner

*Primary Examiner*—William M Pierce
(74) *Attorney, Agent, or Firm*—Craig M. Stainbrook; Stainbrook & Stainbrook, LLP

(57) ABSTRACT

A dice game and a method of playing the same, the game including a dice throwing arena having a floor and a circumferential barrier wall for confining thrown dice, a set of chips with each bearing a point value, a chip rack for visually displaying the set of chips in stacks organized according to the indicated point value of the chips, and a set of set of five six-sided dice, either having conventional markings on the respective faces signifying integers 1-6 and wherein odd numbered faces are marked with one color and even numbered faces are marked with a different color, or having alphabetic letters marked on the respective faces. Players roll the five dice in turns and collect chips under a set of rules that encourages strategic decision making to take advantage not only of chip values, but potential bonus points awarded for the particular combinations of chips collected during the course of play.

6 Claims, 4 Drawing Sheets

FIG. 4
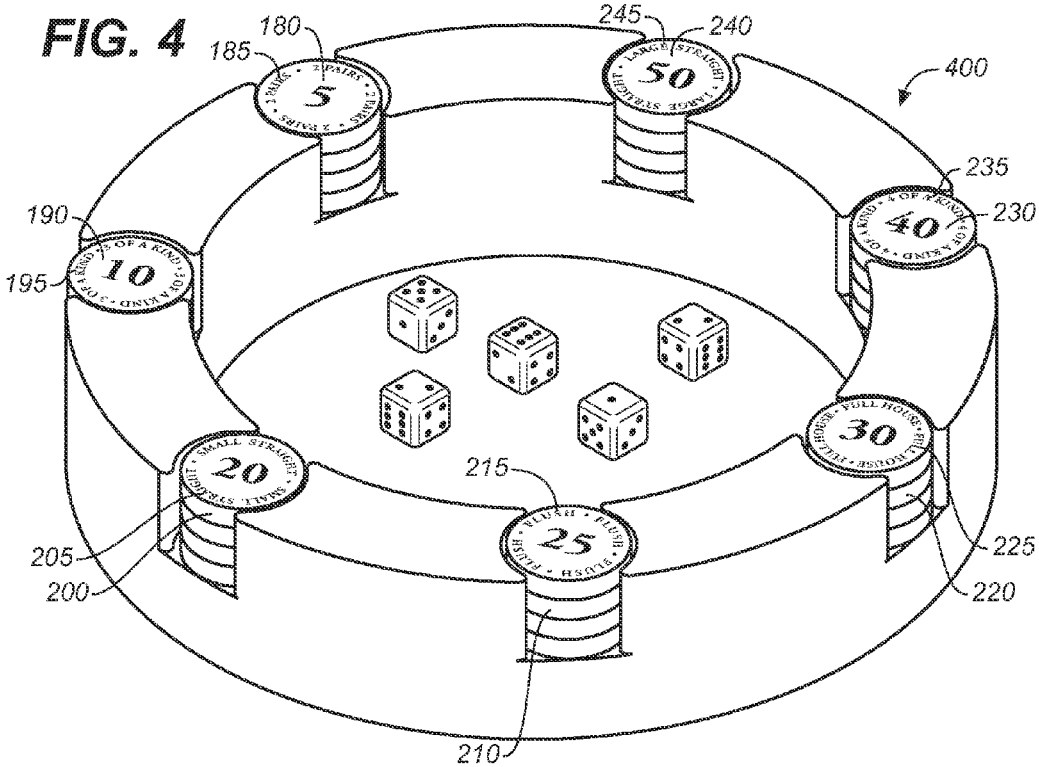
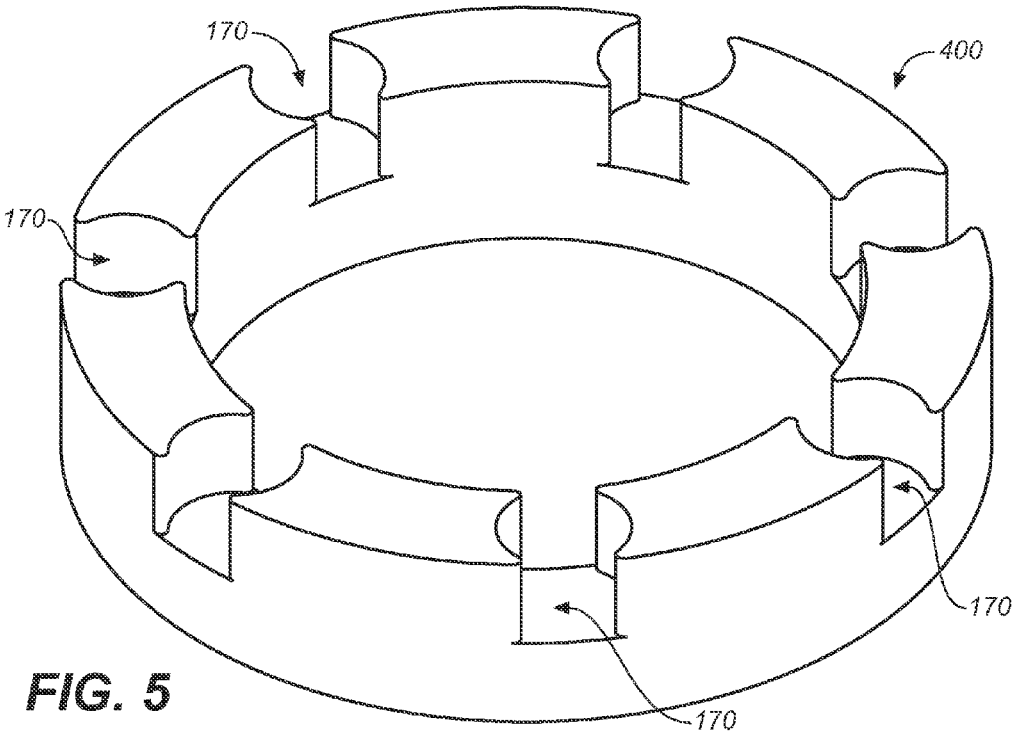
FIG. 5

DICE POKER GAME

CROSS REFERENCES TO RELATED APPLICATIONS

Not applicable. The present application is an original and first-filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to dice game, and more particular to poker inspired sequence dice games, and still more particularly to a dice game that introduces chip selection as a strategic element to a poker-based dice game.

2. Discussion of Related Art Including Information Disclosed Under 37 CFR 61.97, 1.98:

Dice poker and variations on dice poker are well known. The traditional English game of dice poker has been imported and modified in several countries, including the Latin American game of Generala (sp. "Alert"). However, by far the most popular version of dice poker goes by the name of Yacht in Canada, and is variously referred to as Cheerio, Yot, and Yam in the United Kingdom. A version of this game has been popularized in America as YAHTZEE® [a registered trademark of Hasbro, Inc. of Pawtucket, R.I.] The game is a sequence, or turn-based, dice game that has as a principal object to gain the highest number of points possible using a scoring scheme that associates points according to the results of rolls of several dice at a time. It can be played as a kind of solitaire or with a virtually unlimited number of players, but even when played as group the games involve nothing more than several players playing the solitary version generally together with turns taking place in order. Several countries have introduced scoring variations, though the general principals of the game remain largely unchanged.

The object of these dice games is to achieve the highest possible score from throwing 5 dice during a turn. At each turn, each player gets five dice to roll. In the manual version of the game, all five dice are placed in the dice cup and the cup is covered with a hand and shaken. The cup is then turned over, usually somewhat ceremoniously and dramatically as players are wont to endow the roll with precatory energy. After this initial roll, the player may either score that roll and end the turn, or he/she may elect to reserve some dice showing their results and then re-roll the remaining dice. Each player has a maximum of three rolls on each turn, which include the initial roll of all five dice, and then two possible but option re-rolls of some or all dice. After three rolls the player must choose one of 13 categories to score and enter a score for that category.

After a player scores the roll, he passes the cup to the next player. If playing solitaire, he simply initiates a new turn. The process is repeated in turn until each player has completed 13 rounds, each round addressing one of the 13 possible categories. When the game concludes, each player will have entered a score for each category. The game ends once all 13 categories have been scored. Once a category has been scored, it cannot be scored again for the rest of the game (except for a special category for rolling a five-of-a-kind). The game scorecard plays an important role in the execution and strategic decision making, and scoring either involves entering the total of the pips indicated on the rolled die (upper section) or achieving specified combinations on the die face, such as 3 and 4 of a kind, full house, small and large straights, flush, and the like (lower section). Obviously, the dice combinations correspond to poker hands and even bear the same name.

A special bonus situation arises when a 5-of-a-kind is rolled. Additional rolls of five-of-a-kind reward the player with bonus points or the choice of using the roll as a wild card. The player may also elect to score a "Chance" category or may score any roll in any category at any time, even if the resulting score is zero, which is known as a "scratch" or "dump" score.

In Yacht, as with all card and dice games, luck is the principal element in determining the outcome. However, strategy is also quite important, as each player must elect and scoring in only one scoring category at each turn. Because the number of different scoring combinations equals the number of turns in the game, each player must make difficult at each turn as to when to select a particular category in which to enter a score.

However, for all its popularity, Yacht, and its American counterpart, has features that limit its comparison to card poker. Most notably, it fails to provide suit markings. Some dice games have been devised to improve on the imperfect implementation of a dice-based card game by marking the dice with a suit and a rank. However, this is simply not possible in Yacht, as the dice do not include a color feature and other marking corresponding to a suit. Accordingly, combinations corresponding to flushes cannot be achieved.

Thus, in addition to Yacht, other dice games inspired by cards include those shown in the following United States patents: U.S. Pat. No. 4,258,919 to Martelli teaches the use of five game dice having faces that include six symbols similar to those of standard playing-cards. It also includes the use of a new suit that increases the possible combinations when using six-sided dice. The markings corresponding to numbered playing cards, ace through nine, are distributed among the dice in such a way that straight flushes and fours of a kind can be rolled.

U.S. Pat. No. 5,405,145 to Jones, et al, discloses a dice game that uses seven cubic dice bearing numeric indicia with each of six dice having faces marked from 1 to 6, and a seventh having one of its faces marked with the letter "W" defined as "wild" and the other five faces unmarked. A dice cup and rectangular dice box are used, the latter having a bottom and four side walls to define a playing space for throwing the dice. Points are tallied according to the poker combinations shown on the dice in an initial or repeat throw.

U.S. Pat. No. 4,436,306 to Sanders, describes a card-inspired dice game using eight-sided game dice having suit attribute markings. This is a variant on the game of Yacht, which again introduces the possibility of flushes and straight flushes, as in the card game of poker. Each die is eight-sided, and carries a unique combination of numerical attribute markings and suit attribute markings, selected from a range of eight numerical values and five suits.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein. Specifically, to date there is no known poker based dice game that includes the display and use of chips and chip selection as a strategic element.

BRIEF SUMMARY OF THE INVENTION

The present invention is a sequence dice game in the tradition of Yacht, Generala, and Cheerio. It includes a dice throwing arena with a floor surrounded by a barrier wall sufficiently high to contain and confine thrown dice within the area defined by the floor. A set of chips are provided, the set including equal numbers of chips of varying point values. Before the start of play, the chips are stacked in a chip rack that displays the chips according to their indicated point value. Five dice are employed, each bearing numerical indicia corresponding to integers 1-6, but the odd numbered faces are marked with one color and even numbered faces bear a different color. Players roll the five dice in turns, each turn comprising one to throws of the dice in an effort to achieve predetermined scoring combinations that correspond to the hands in card poker. Players collect chips according to a set of rules matching scoring combinations with chip collection rules. The chip collection rules encourage complex strategic decision making such that players attempt to earn high points not only by collecting chips bearing high point values, but by earning bonus points for achieving special combinations of chips.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 4 is an upper perspective view of a second preferred embodiment of the game board and playing articles of the present invention;

FIG. 5 is the same view as FIG. 4 with the chips and die removed; and

DETAILED DESCRIPTION OF THE INVENTION

Figure 1:
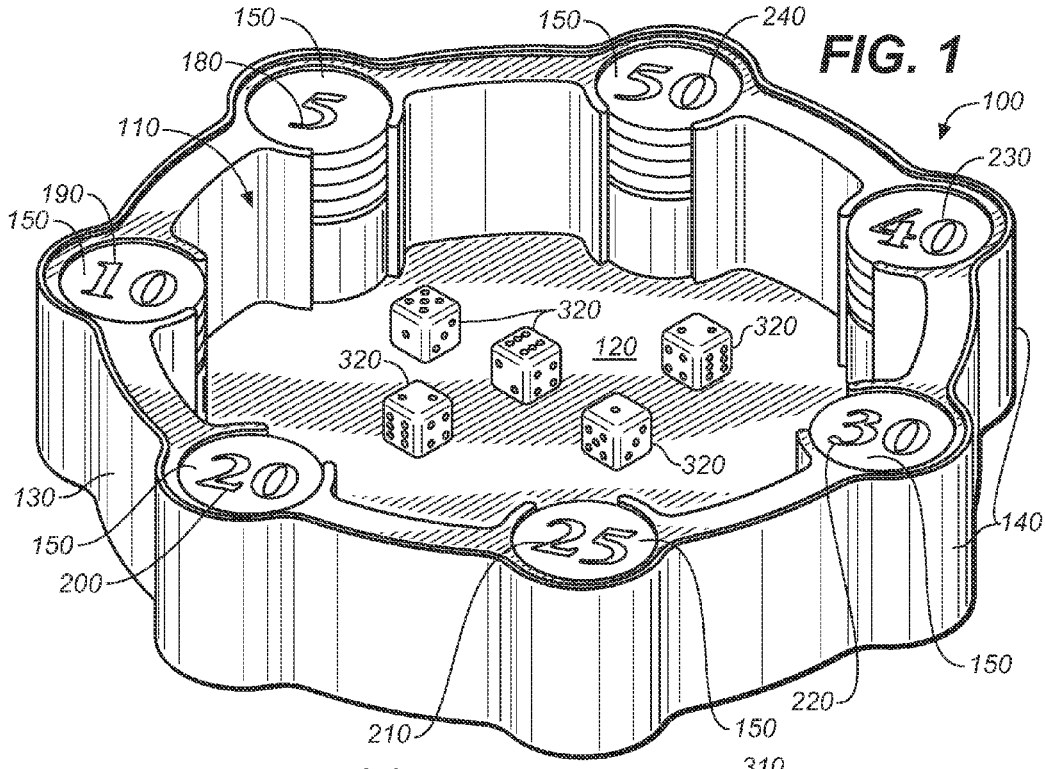
FIG. 1 is an upper perspective view of the game board and playing articles (chips and die) of the present invention, as might be seen by one of several players positioned around the game board.

Referring to FIGS. 1 through 6, wherein like reference numerals refer to like components in the various views, there is illustrated therein a new and improved poker-based sequence dice game, the board and playing equipment for which collectively are generally denominated 100 herein. These views show how the game board and playing articles of the present invention provide a simple but elegant means for adding a new strategic element to the prior art die poker games.

Figure 2:
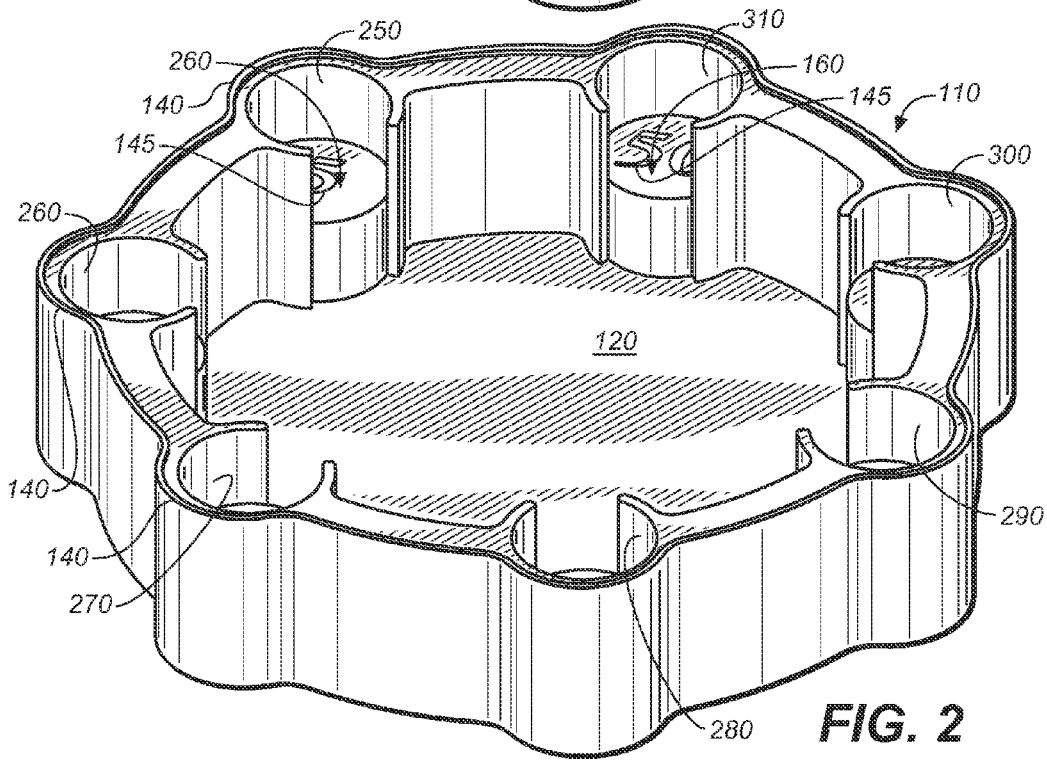
FIG. 2 is the same view of the game board of FIG. 1, with the chips and die removed.
Figure 3:
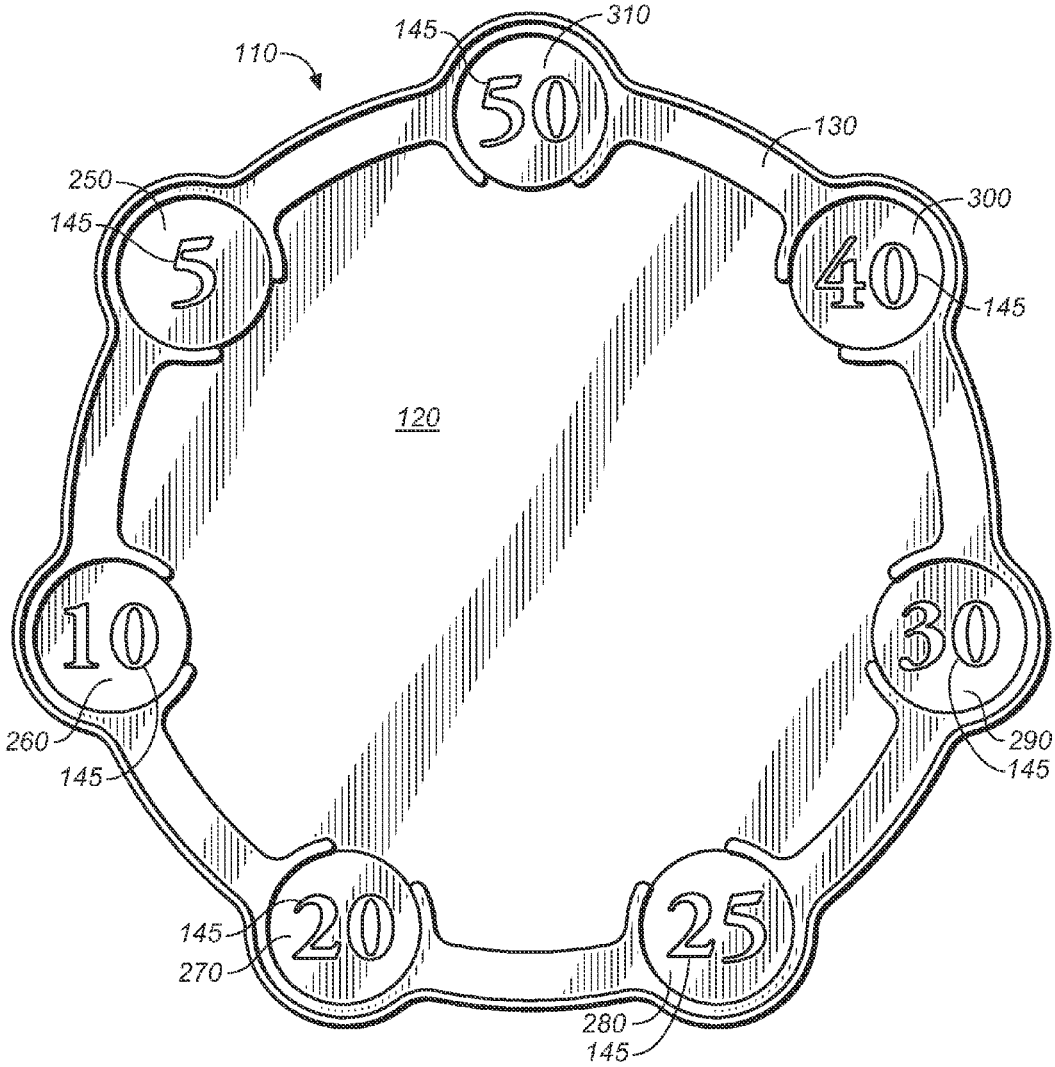
FIG. 3 is a top plan view thereof.

Referring first, then, to FIGS. 1-3, there is shown a first preferred embodiment of the inventive game equipment, which includes a dice throwing arena 110 having a bottom or floor 120, and a circumferential barrier wall 130, which may be generally round or polygonal. The barrier wall functions to define the dice throwing area and confines dice when thrown with reasonable force within the bounded area of the floor. The barrier wall includes an integrally formed chip rack comprising a plurality of integrally formed spaced apart cylindrical chip cups 140 which may be generally evenly spaced apart or may be disposed at the corners or intersections of polygonal sides so as to define the vertices. The chip cups are sized to accommodate a number of chips 150 of varying point values, all of which are stacked in a generally flat arrangement. The chip cups are preferably provided with a point marking 145 on their bottom surface so as to facilitate the proper placement of chips at game set up. Each chip cup also includes at least a vertically oriented interior side slot 160 and possibly both an interior side slot and an exterior side slot 170 (see FIGS. 4-6) so that the number of chips remaining in each cup can be viewed easily. This also facilitates the manual removal of chips from the chip cups by allowing a fingertip to be inserted through the slot to tip a chip and then grasp it between fingers. Preferably, in a first preferred embodiment of the game, there are seven different chips, 180, 190, 200, 210, 220, 230, and 240, each having their value clearly indicated on at least one side. The chips of each value are placed into a respective chip cup 250, 260, 270, 280, 290, 300, 310, having a value corresponding to the chip. In a first preferred embodiment, there are chips and chip cups having indicia for point values of 5, 10, 20, 25, 30, 40 and 50 points, respectively. It will be appreciated, however, that chips could be assigned any of a number of suitable point values, and the rules applicable to chip collection would still apply and would result in the same game outcome, as long the relative chip values remain the same. Accordingly, under the scoring scheme of the present invention, the lowest chip may be assigned a value of x, in which event the second lowest chip value is 2x, the third chip value is 4x, the fourth chip value is 5x, the fifth chip value is 6x, the sixth chip value is 8x, and the $7^{th}$ chip value is 10x.

Further, in a first preferred embodiment of the game, there are provided four chips for each point value, for a total of 28 chips. However, the scoring scheme and the game strategy would not be undermined were there to be disparate numbers of chips at different point values. There could, for instance, be 5 chips having a 5 point value, 7 chips having a 10 point value, 10 chips having a 20 point value, and so forth. Indeed, introducing variations in the number of chips would create interesting and entertaining challenges to the players as they adapted their strategy to address more complex calculations and predictions. The most important element of the chip set resides, therefore, not in the point values of the chips taken alone, but instead in the chip point values, bonus point values, and most importantly in the overall conditions under which the chips are used during play, including the physical distribution and visual presentation of the chips in flat stacks around the dice arena in such a way as to provide the players the means to obtain information needed for formulating strategy. The chips could be laid in a horizontal stack, as well, but only if the stack or chip holder were provided with a marking making it immediately clear to the players the number of chips of a certain point value that remained uncollected.

Next, the game includes a set of five six-sided dice 320, preferably conventional dice with each face bearing pips numbered in the amount of 1-6 pips, or alternatively arabic numerals 1-6, or other markings corresponding to the numeric equivalents. Odd numbered faces are marked with one color, and even numbered faces bear another color, these colors roughly corresponding to two of the four suits available in conventional playing cards.

Figure 6:
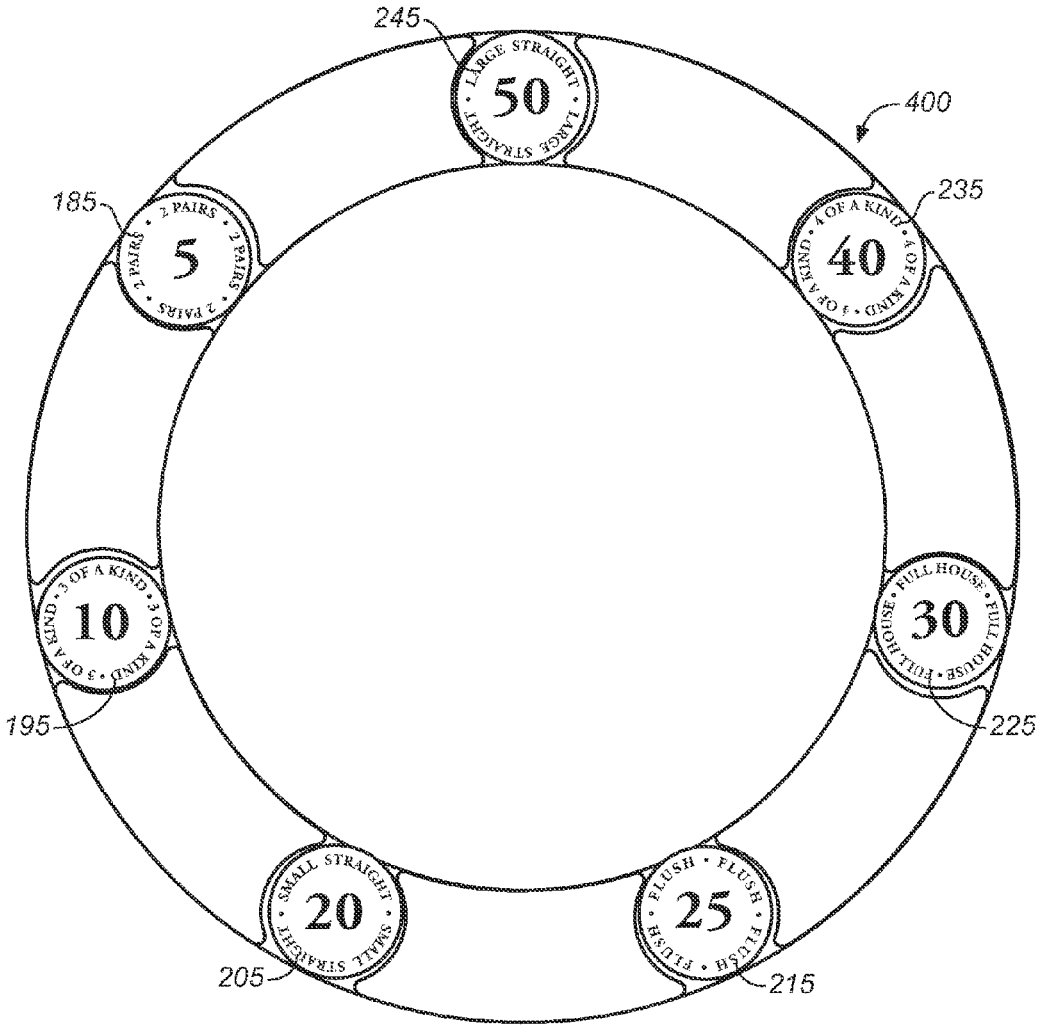
FIG. 6 is a top plan view thereof.

Referring next to FIGS. 4-6, there is shown a second preferred embodiment 400 of the inventive dice game. In this embodiment, there is included an exterior slot 170 for each chip cup in addition to the interior slot 160 provided in the first preferred embodiment. This further facilitates both the view of each chip stack and easy removal of the chips from the chip cups. Otherwise, the dice arena is functionally and structurally identical to the arena of FIGS. 1-3.

As with other sequence dice games, the object of the game is to achieve the highest score at the end of the game.

Play is preceded by first setting up the dice throwing arena. The chips are stacked in the chip rack according to their respective point values. The number of chips in each stack may be immediately appreciated by looking at the side slot, which reveals the chips remaining in each slot during game play. This is an important aspect of the game, as a routine inspection of the chips available in each chip cup and in the chip collections of opposing players provides the players with important visual information to assist in making chip collection decisions. To facilitate the evaluation of opposing players' chip collections, during play each player must organize his chip collection in a line of stacks in order of point value, either left to right or right to left in increasing values. The line of stacks comprises each players "collected chips."

Play commences with a competitive roll of a single die, i.e., each player throws a single die onto the arena floor. The player with the highest roll goes first, and in the case of ties a roll off is held until a highest roll is determined. Play proceeds clockwise in sequence. At each turn, the rolling player rolls all five dice in an initial roll. The player may keep any one or several of the rolled dice in order to achieve any one of the eight scoring combinations possible under the rules. At each turn, a player has up to a maximum of three roles to achieve that objective.

The scoring combinations possible in the inventive game include: two pairs of matching dice, which is scored as 5 points; three-of-a-kind, worth 10 points; a small straight, worth 20 points; a flush, worth 25 points; a full house, worth 30 points; four-of-a-kind, worth 40 points; a large straight (which must be either 1-5 or 2-6 and which cannot be a flush under the two color system employed), worth 50 points; and a five-of-a-kind, which is given the proprietary name of Yamslam to connote a special scoring choice (discussed below).

If points are earned during a roll for having achieved one of the foregoing combinations, a chip may be collected. As noted, in a preferred embodiment, there are a limited number of chips for each point value, most preferably four chips per point value. The rules for collecting chips are as follows: (a) If during any turn a player's role achieves one or more of the above-described scoring combinations, whether on the initial roll or any subsequent roll, the player may elect to collect a chip and end his turn. (b) If the roll matches more than one scoring combination, the player may elect to take one chip of his or her choice corresponding to one of the scoring combinations, and he or she may then roll again. For instance, if a player rolls four of a kind, that satisfied the 2 pairs combination (5 point chip), the 3-of-a-kind combination (10 point chip), and the four-of-a-kind combination (40 point combination); (c) If none of the rolls during a player's turn produce a match to a scoring combination, no chip may be collected; (d) if no player collects a chip during a round of play, each player must discard one chip of the highest value from the chip rack and place it in a discard pile. A chips from the discard pile may only be collected if a Yamslam is rolled. To facilitate chip collection, the scoring combinations associated with chip point values may be clearly marked on the chips, 185, 195, 205, 215, 225, 235, 245 (see FIGS. 4 and 6).

End game: The game ends when the last remaining chip is removed from the chip cups. At this point each player evaluates his or her stack to determine eligibility for bonus points, which are awarded as follows: (a) If at least one chip of each point value has been collected, this is a "Golden 7," worth 50 bonus points; (b) if six different chips of different values have been collected, this is a "Silver 6," worth 20 points (but this is not awarded in addition to a Golden 7, if such is available); (c) for each complete stack of 4 chips of any point value, this is a "full stack" worth 30 points each; and (d) for taking the last chip remaining in the chip rack is worth 20 bonus points.

After including all available bonus points, each player totals the points in his/her collected chips and adds the bonus points. The player with the highest point total is the winner.

As a variation, multiple games can be played in succession, and the declaration of a winner can be suspended until a cumulative total is first reached by one of the players.

As another variation, the game can be played as a kind of solitaire, wherein chip collection rules are appropriately modified as follows: (a) during each roll in which a chip cannot be collected, a collected chip having the highest point value must be discarded into a discard pile; (b) a Yamslam is rewarded with the choice of taking any two chips from either the chip rack or the discard pile; and (c) bonuses apply according to the regular rules.

In yet another variation, the inventive game may be played in teams of two players per team, with chip selection and dice rolls alternated between the members of each team.

In still another variation, the inventive game may be played with dice that include alphabetic indicia rather than numeric indicia, and points are accumulated by making words and word combinations, complemented by chip collection strategies. In such a variation, it is contemplated that many more than five dice may be employed, as alphabetic combinations reasonably required to spell various words and word combinations calls for more than 30 faces on six-sided dice. Thus, up to sixteen dice may be employed for a word version of the inventive dice game in which chip selections are a strategic element of the overall point accumulation strategy. In this variation of the game, word length is factor considered in earning points on the roll itself, much as the complexity and unlikelihood of rolling a poker hand is such a factor in the foregoing variations. Then the players make choices for selecting chips that are driven not only by the points available from spelled words and word combinations, but by the chips already collected and the benefit of securing chips that will result in bonus points.

It will be appreciated from the foregoing that chip selection becomes a critical strategic element. Choices for any player will be informed by one's own chip collection, the opposing player's collected chips, the chips remaining in the chip rack, the probabilities of achieving rolls that will earn chips having certain values, either in the chip rack or the discard pile, the availability of bonus points both for oneself and for the opposing players, and so forth. Accordingly, at each roll a player will be performing a complex calculus involving a number of factors designed to optimize the probability of achieving the highest possible score. No other game provides the visual and strategic elements necessary for such an interesting game experience.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A sequence dice game, comprising:

dice throwing arena having a floor and a circumferential barrier wall for confining thrown dice within the area defined by said floor;

a set of chips, each chip having at least one side with markings indicating a point value, wherein the number of chips bearing a distinct point value is the same as the number of chips bearing any other point value, and wherein the lowest point value on any chip in said set of chips is assigned some number x, the second lowest indicated point value is 2x, the third indicated point value is 4x, the fourth indicated point value is 5x, the fifth indicated point value is 6x, the sixth indicated point value is 8x and the seventh indicated point value is 10x;

a chip rack for visually displaying said set of chips in stacks organized according to the indicated point value of the chips; and a set of set of five six-sided dice, each having a face bearing indicia indicating a number corresponding to the integers 1-6, and wherein odd numbered faces are marked with one color and even numbered faces bear a different color.

2. The dice game of claim 1, wherein said barrier wall is substantially round.

3. The dice game of claim 2, wherein said chip rack is integrally formed in said barrier wall and includes a plurality of spaced apart chip cups.

4. The dice game of claim 1, wherein said barrier wall is polygonal and said chip rack comprises a plurality of chip cups integrally formed in said barrier wall, and wherein one of each of said plurality of chip cups defines a vertex where two sides of said polygon converge.

5. The dice game of claim 1, wherein said chip rack is integrally formed in said barrier wall and includes a plurality of chip cups, each having a vertically oriented interior side slot providing a view of the number of chips stacked in each of said chip cups.

6. The dice game of claim 5, wherein each of said chip cups includes an exterior side slot.

* * * * *